US006305341B1

(12) United States Patent
Saiga

(10) Patent No.: US 6,305,341 B1
(45) Date of Patent: Oct. 23, 2001

(54) FUEL SUPPLY APPARATUS OF OUTBOARD MOTOR

(75) Inventor: Jiro Saiga, Hamamatsu (JP)

(73) Assignee: Suzuki Kabushiki Kaisha, Hamamatsu (JP)

( * ) Notice: Subject to any disclaimer, the term of this patent is extended or adjusted under 35 U.S.C. 154(b) by 0 days.

(21) Appl. No.: 09/589,173

(22) Filed: Jun. 8, 2000

(30) Foreign Application Priority Data

Jun. 8, 1999 (JP) ..... P.11-161405

(51) Int. Cl.[7] ..... F02F 7/00

(52) U.S. Cl. ..... 123/195 A; 123/195 P; 123/583

(58) Field of Search ..... 123/198 R, 195 P, 123/580, 583, 179.18, 396, 195 A, 184.57

(56) References Cited

U.S. PATENT DOCUMENTS 4,126,303 * 11/1978 Yanagisawa et al. ..... 267/34

5,524,596 * 6/1996 Nakai et al. ..... 123/583

* cited by examiner

*Primary Examiner*—Noah P. Kamen

(74) *Attorney, Agent, or Firm*—Oblon, Spivak, McClelland, Maier & Neustadt, P.C.

(57) ABSTRACT

An outboard motor with an engine having a crankcase in which a crankshaft is perpendicularly arranged in a state that the outboard motor is mounted to a hull. The outboard motor is provided with a fuel supply apparatus that includes an interlocking mount member to be mounted to the engine, a plurality of air-fuel mixture supply devices mounted to the interlocking mount member, an intake noise silencer mounted to the air-fuel supply means, an engine starting operation assisting device for assisting smooth starting of an engine operation, and a speed reduction control device for preventing engine stall. The starting operation assisting device and the speed reduction control device are mounted to the interlocking mount member as one unit.

4 Claims, 6 Drawing Sheets

FUEL SUPPLY APPARATUS OF OUTBOARD MOTOR

BACKGROUND OF THE INVENTION

The present invention relates to a fuel supply apparatus of an outboard motor having an improved arrangement or structure.

In recent years, a four-stroke-cycle engine has been mainly utilized. Like the two-stroke-cycle engine, the four-stroke-cycle engine is mounted uprightly to the outboard motor in a state mounted to a hull, for example, in which a crankshaft is disposed so as to extend perpendicularly in an engine crankcase.

An intake manifold extending from a cylinder head on the rear side of the engine is curved and connected to a cylinder block or a fuel supply apparatus disposed on the side of the crankcase. An air-fuel supply means such as carburetors as many, in number, as cylinders or an air amount-adjusting device (throttle body) is continuously formed with the fuel supply apparatus by a connecting member, and an intake (inlet) noise silencer is connected to the front portion of the fuel supply apparatus.

An engine starting operation assisting device for easily starting the engine operation and a speed reduction control device for preventing an engine stall resulted from a rapid throttle closing operation are disposed in association with the fuel supply apparatus of the outboard motor.

In the known art, such engine starting operation assisting device and the speed reduction control device are disposed to the cylinder head of the engine independent from the air-fuel supply means. For this reason, it is necessary to carry out a setting operation such as linkage adjustment in an assembling line after the assembling of the air-fuel supply means, the starting operation assisting device and the speed reduction control device.

However, in such engine assembling line, the setting adjustment working is troublesome and inconvenient for the entire assembling working, which results in adverse affection on the outboard motor manufacturing process, as well as adverse affection on uniform or constant engine performance after the assembling of the engine. Moreover, it is necessary to again perform the setting adjustment working at the time of re-assembling of the engine after the once disassembling of the air-fuel supply means, thus being troublesome and not convenient for the engine performance and maintenance.

SUMMARY OF THE INVENTION

The present invention was conceived to solve or substantially eliminate defects or drawbacks encountered in the prior art mentioned above, and a primary object of the present invention is to provide a fuel supply apparatus of an outboard motor in which the outboard motor can be easily manufactured by enabling various setting workings before the assembling of the fuel supply apparatus with the engine to thereby easily manufacture the outboard motor with uniform engine operation performance having no defect due to the setting working.

Another object of the present invention is to provide a fuel supply apparatus of an outboard motor capable of making the fuel supply apparatus into a small assembly, which is easily detachable to an engine of the outboard motor for easy transportation, packaging and maintenance.

These and other objects can be achieved according to the present invention by providing a fuel supply apparatus of an outboard motor provided with an engine having a crankcase in which a crankshaft is perpendicularly arranged in a state that the outboard motor is mounted to a hull, the fuel supply apparatus comprising:

an interlocking mount member to be mounted to the engine;

a plurality of air-fuel mixture supply means mounted to the interlocking mount member;

an intake noise silencer mounted to the air-fuel supply means;

a starting operation assisting device for assisting smooth starting of an engine operation; and a speed reduction control device for preventing an engine stall from causing, the starting operation assisting device and the speed reduction control device being mounted to said interlocking mount member.

In a preferred embodiment, the intake noise silencer is mounted detachably to the air-fuel mixture supply means after the air-fuel supply means is mounted to the engine. The intake noise silencer is mounted to the air-fuel supply means through intake pipes.

Further, the air-fuel supply means are preferably a plurality of carburetors.

According to the structures or characters of the present invention mentioned above, the air-fuel mixture supply means, the engine starting operation assisting device and the speed reduction control device are assembled together as one unit with the interlocking mount member. Therefore, the setting adjustment between these members can be performed before the assembling with the engine, thus workability for the manufacturing of the outboard motor can be improved. Moreover, the engine performance influenced by the setting working of the fuel supply apparatus can be uniformly achieved. Furthermore, even if the fuel supply apparatus is detached from the engine, the relative positional relationship of the starting operation assisting device and the speed reduction control device with respect to the air-fuel supply means is not changed, so that the adjustment working can be eliminated which was required every assembling time in the prior art, so that the workability can be improved and the re-adjusting working can be eliminated, thus remarkably improving the engine performance and maintenance working.

Still furthermore, according to the further feature of the present invention, since the intake noise silencer can be mounted to the air-fuel mixture supply means such as carburetor after being assembled to the engine body, and accordingly, it is not necessary for the intake noise silencer to be initially mounted to the air-fuel mixture supply means, and hence, the fuel supply apparatus, as a whole structure, can be handled as small one unit, being convenient for transportation, storage, packaging workings.

The nature and further characteristic features of the present invention will be made more clear from the following descriptions made with reference to the accompanying drawings.

DESCRIPTION OF THE PREFERRED EMBODIMENT

A preferred embodiment of the present invention will be described hereunder with reference to the accompanying drawings.

Figure 1:
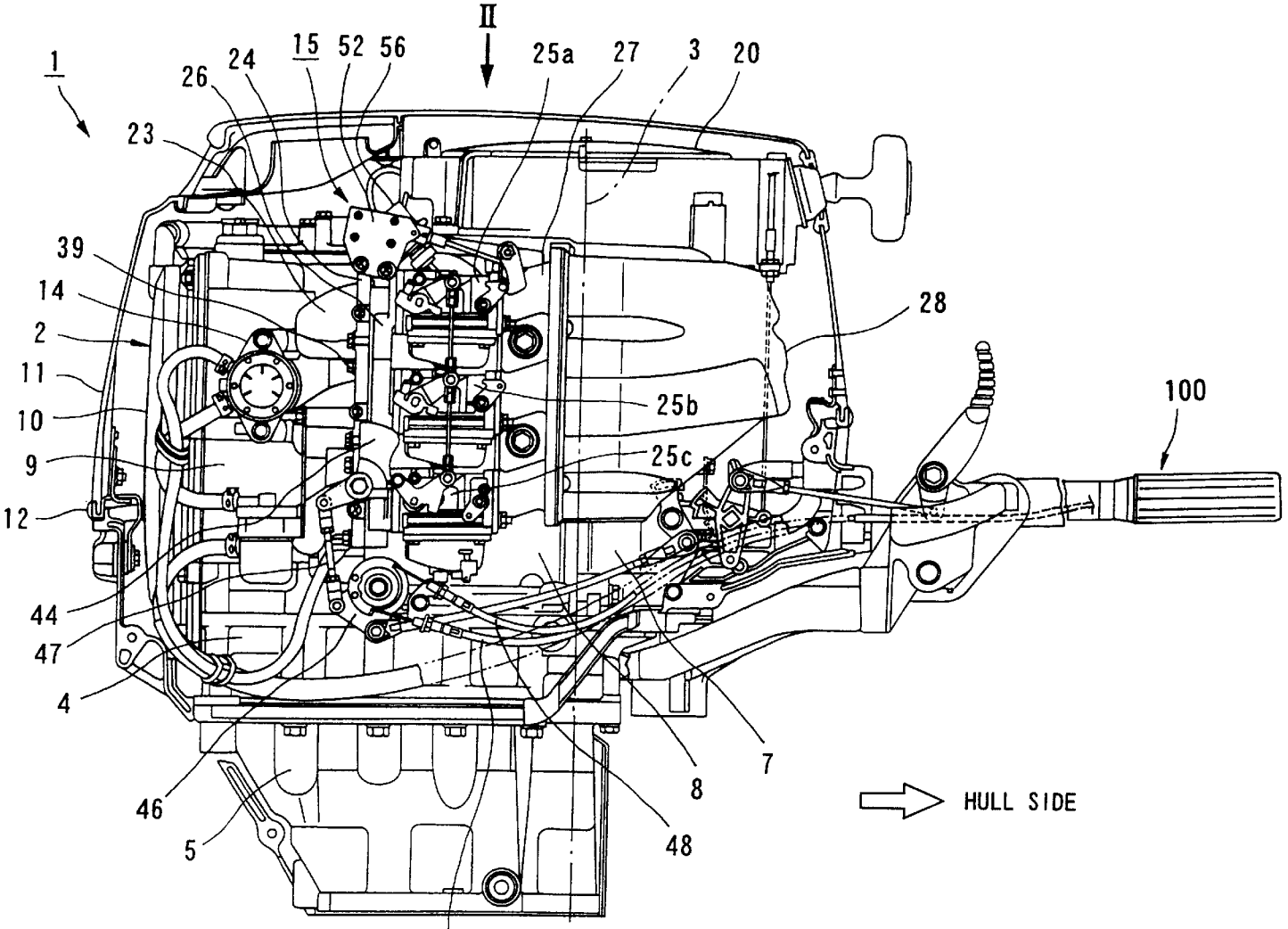
FIG. 1 is a right side view of a portion of an outboard motor near an engine thereof to which the present invention is applicable.

With reference to FIG. 1, an outboard motor 1 has a forward portion (right side portion as viewed) which is mounted to a hull, for example, and has a rearward portion (left side portion as viewed).

Figure 2:
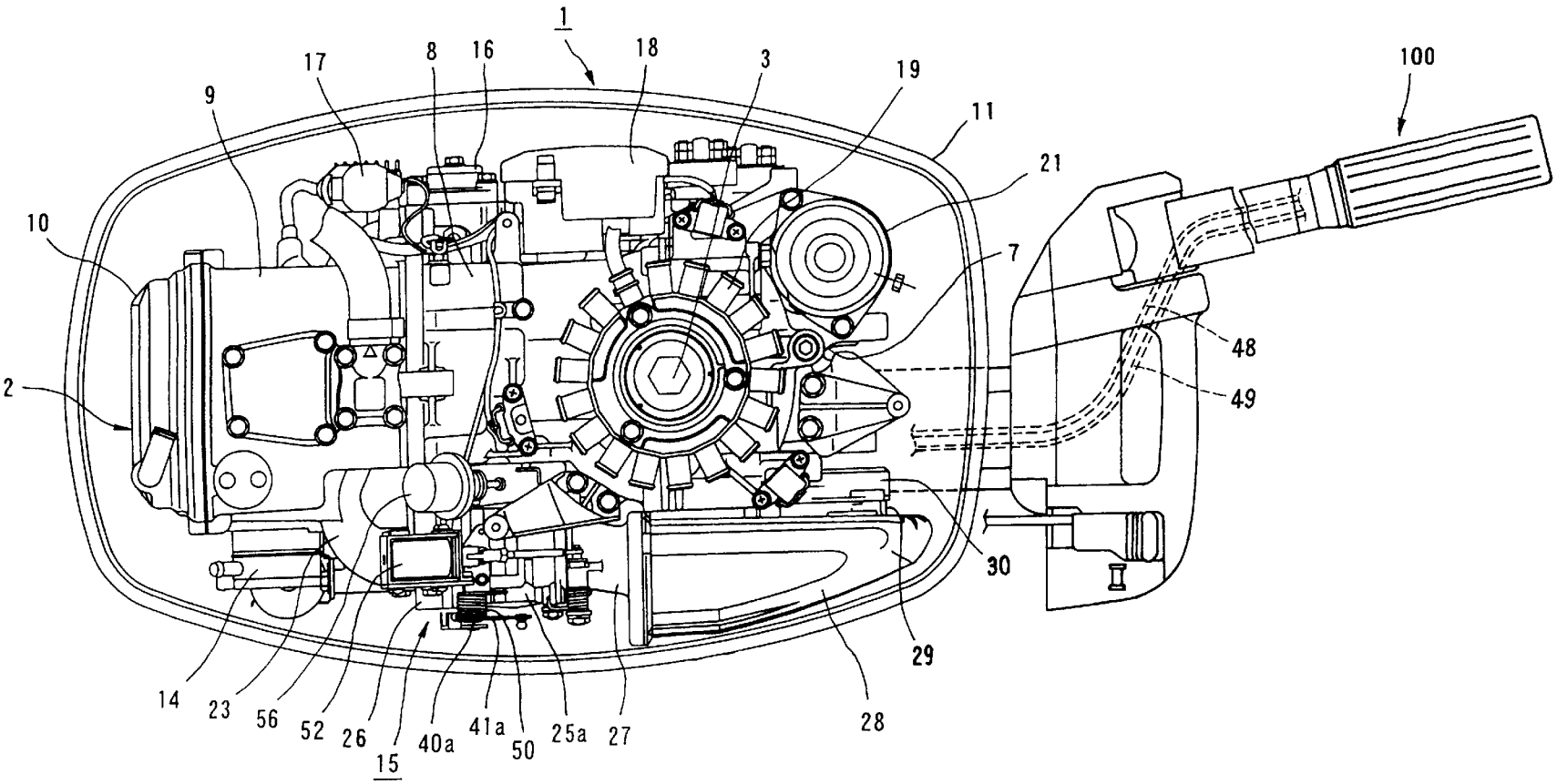
FIG. 2 is a plan view of the outboard motor shown from a direction of an arrow II in FIG. 1.

With reference to FIGS. 1 and 2, an engine 2 is mounted to the outboard motor 1 at an upper portion thereof in a state of the outboard motor 1 mounted to a hull, for example. The engine 2 is, for example, an in-line three-cylinder four-stroke-cycle engine, and the engine 2 is disposed above an engine holder 4 having substantially flat-plate like structure, in which a crankshaft 3 (which is shown only with its central axis in FIG. 1 for showing the position thereof) is perpendicularly arranged.

An oil pan 5 is fixedly mounted to a lower portion of the engine holder 4, and a drive shaft housing and a gear housing, which are not shown, are disposed below the oil pan 5. A screw propeller is also provided for the gear housing.

In the engine 2, there are disposed, from the front side (right side as viewed in FIG. 1), a crankcase 7, a cylinder block 8, a cylinder head 9 and a head cover 10. The entire structure of the engine 2, the engine holder 4 and the oil pan 5 are covered by an engine cover 11 formed of synthetic resin material for waterproofing. The engine cover 11 comprises upper and lower half cover sections with a sealing member portion 12 being a boundary therebetween, and engine maintenance or inspection is performed by removing the upper half cover section.

A fuel supply apparatus 15 together with a fuel pump 14 is disposed, for example, on a right side of the cylinder block 8 of the engine 2, and an exhaust device 16, an ignition device 17, an electrical equipment box 18 and the like are disposed on a left side of the cylinder block 8. Furthermore, a generator (dynamo) 19 (FIG. 2) and a re-coil starter 20 (FIG. 1) are disposed to an upper portion of the engine 2, and a starter motor 21 is also disposed to a front portion of the engine 2.

An intake manifold 23, which is formed with thee input pipes, disposed so as to extend from the right side surface portion of the cylinder head 9, and these input pipes are curved forward by about 90° and connected to a substantially flat plate-like connection flange 24. The input pipes of the intake manifold 23 and the connection flange 24 are integrally formed together with the cylinder head 9.

Figure 3:
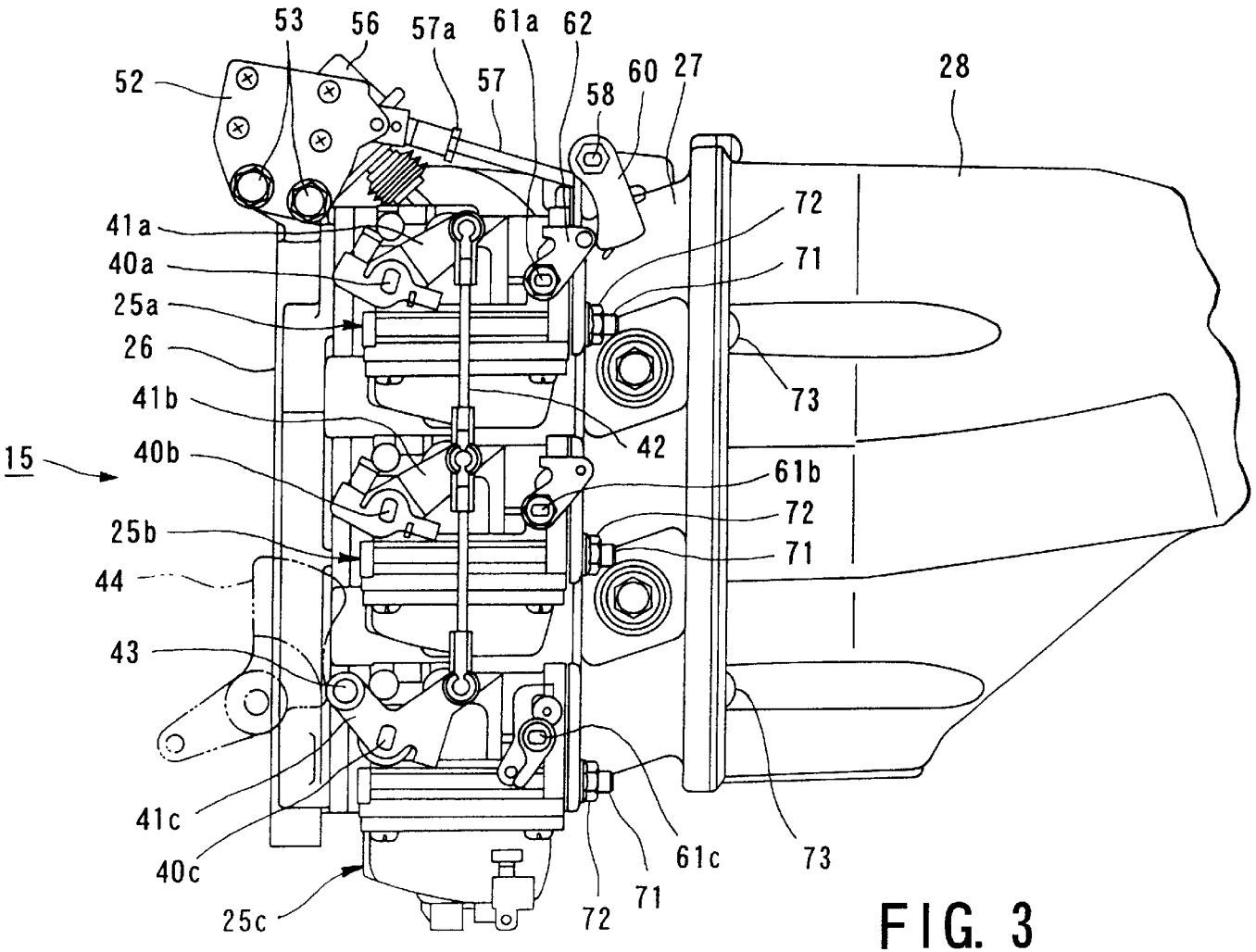
FIG. 3 is a right side view of a fuel supply device of the outboard motor of FIG. 1.
Figure 4:
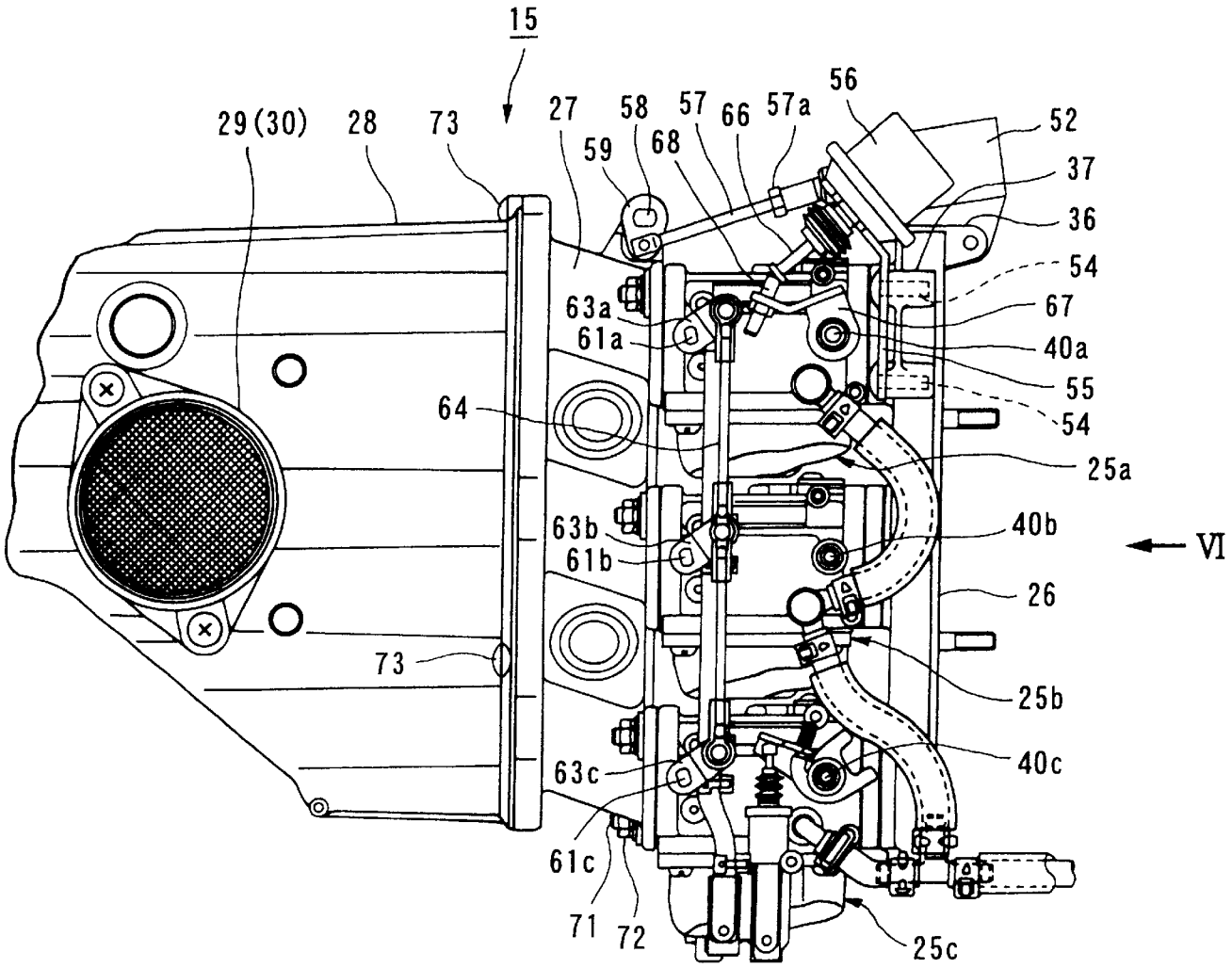
FIG. 4 is a left side view of the fuel supply device of the outboard motor representing one embodiment of the present invention.
Figure 5:
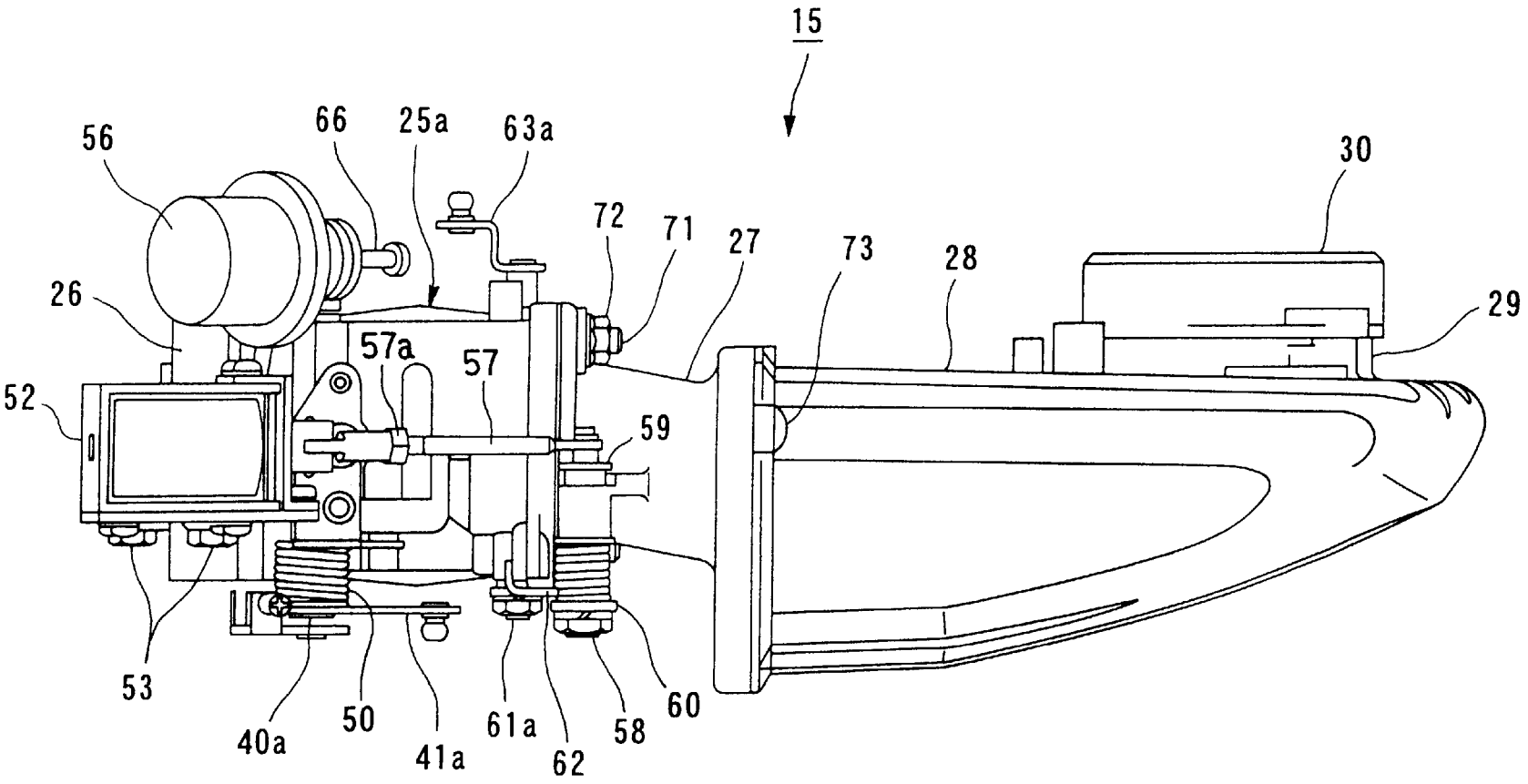
FIG. 5 is a plan view of the fuel supply device.

With reference to FIGS. 3 to 5, in the fuel supply apparatus 15, three carburetors 25*a*, 25*b* and 25*c* are vertically continuously mounted to a substantially flat plate-like mounting member 26 as an interlocking mount member, and an intake (inlet) noise silencer 28 is connected to front portions of the carburetors 25*a* to 25*c* through an intake pipe (pipes) 27. The intake noise silencer 28 is provided, at its surface portion on the side of the engine 2, with an intake port 29 (FIG. 2 or 4), to which a flame arrester 30 is provided. Further, although these carburetors serve as air-fuel mixture supply means, in the case of the fuel injection type engine, for example, the carburetors man be replaced with air-amount adjusting means (throttle body) of a fuel injector. The carburetors 25*a* to 25*c* are arranged in this order from the upper portion in the state of the outboard motor being mounted to the hull, for example, as shown in FIG. 1, and in this meaning, the carburetor 25*a* is described herein as uppermost one.

Figure 6:
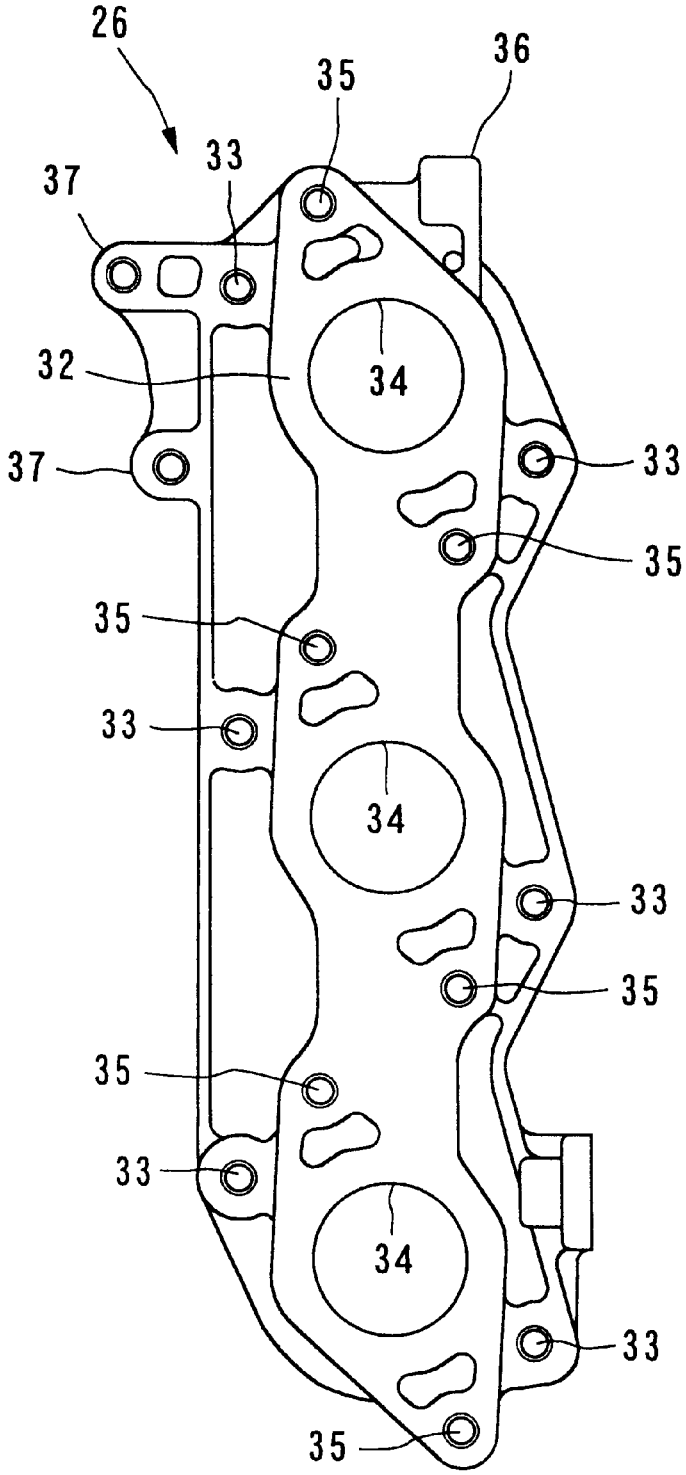
FIG. 6 is a view shown from a direction of an arrow VI in FIG. 4.

As shown in FIG. 6, the interlocking mount member 26 is provided with a connection flange 32 having a shape aligned with the connection flange 24 of the intake manifold 23. The connection flange 32 is formed with six screw holes 33 for fastening the three carburetors 25*a* to 25*c* at its peripheral portion by means of bolts. The connection flange 32 is further formed with three ports 34 to be aligned with the respective input pipes of the intake manifold 23, and a pair of screw holes 35 are formed at opposite side portions of each port 34, that is a pair of holes 35 are formed while the port 34 being positioned therebetween. Furthermore, a fastening members such as seating members 36 and 37 are integrally formed on an upper portion of the mounting member 26.

The carburetors 25*a* to 25*c* and the interlocking mount member 26 are preliminarily assembled as the fuel supply apparatus 15, and the connection flange 32 of the interlocking mount member 26 are mated with the connection flange 24 of the intake manifold 23 and six bolts 39 (FIG. 1) are inserted throughout the screw holes 35 of the interlocking mount member 26, respectively, and then fastened together. Further, a plate-shape gasket, not shown, is disposed between these connection flanges 24 and 32 to ensure air-tight performance therebetween.

Throttle shafts 40*a*, 40*b* and 40*c* are pivotally supported by the three carburetors 25*a*, 25*b* and 25*c* for opening and closing throttle valves, not shown, incorporated in the carburetors 25*a* to 25*c*, respectively. Throttle levers 41*a*, 41*b* and 41*c* are pivoted on right ends of the throttle shafts 40*a* to 40*c* to be rotatable together. Free ends of the throttle levers 41*a* to 41*c* are connected to a linkage link 33 (FIG. 3) so that a cam roller 43 provided for the lowermost throttle lever 41*c* abuts against a cam surface of a throttle cam 44, which is supported by the cylinder head 9, for example.

With reference to FIG. 1, an intermediate lever 46 is supported to the lower portion of the lowermost carburetor 25*c*, and the intermediate lever 46, and the throttle cam 44 are interlocked by means of a throttle link 47. Further, two cables 48 and 49 are coupled, at one ends thereof, to the intermediate lever 46 and, at other ends, to a throttle apparatus 100 disposed at a front portion of the outboard motor, i.e. hull side.

When the throttle apparatus 100 is operated, the intermediate lever 46 is rotated through the two cables 48 and 49, and the rotation of the intermediate lever 46 is transmitted to the throttle cam 44 through the throttle link 47 to thereby rotate the throttle cam 44. The throttle cam 44 then presses the throttle lever 41*c* (cam roller 43) of the lowermost carburetor 25*c*, and the other throttle levers 41*a* and 41*b* are operated in association with the motion of the throttle lever 41*c* through the linkage link 42. Accordingly, the throttle shafts 40*a* to 40*c* of the three carburetors 25*a* to 25*c* are simultaneously driven and rotated, and hence, the throttle valves accommodated in the respective carburetors are synchronously opened or closed to thereby control the engine output power. The three throttle levers 41*a* to 41*c* are usually urged by spring means 50 in a direction closing the throttle valve.

A starting operation assisting device (auto-choke device) 52 is fastened, by means of two bolts 53, to the seating member 36 disposed to the upper portion of the interlocking mount member 26. A speed reduction control device 56 is also mounted to the seating member 37 through a bracket 55 which is fixed thereto by screws 54 (FIG. 4). For example, the starting operation assisting device 52 is disposed to an obliquely rear upper portion of the uppermost carburetor 25*a,* and the speed reduction control device 56 is disposed at a left side portion of the starting operation assisting device 52 side by side.

As such starting operation assisting device 52, a known electromagnetic-type one using a solenoid will be arranged. As shown in FIGS. 3 to 5, an operation rod 57 is disposed so as to extend from the starting operation assisting device 52 and is connected, for example, to an input lever 59 (FIG. 4) of a cam shaft 58 supported to the upper portion of the intake pipe 27. A choke cam 60 (FIG. 3) is mounted to the other end portion of the cam shaft 58.

Three choke lever shafts 61*a,* 61*b* and 61*c* for operating choke mechanisms respectively incorporated in the three carburetors 25*a,* 25*b* and 25*c* are arranged vertically as viewed and supported by these carburetors, and a choke cam 60 abuts against a choke lever 62 (FIG. 3) integrally rotatably mounted to the uppermost choke lever shaft 61*a.* With reference to FIG. 4, Choke interlocking levers 63*a,* 63*b* and 63*c* are mounted to other end side (engine side) of the respective choke lever shafts 61*a,* 61*b* and 61*c* and mutually connected through an interlocking link 64.

When the starting operation assisting device 52 is operated, the operation rod 57 is contracted from the extending position to thereby pull the input lever 59 and, hence, the choke cam 60 presses the choke lever 62 of the uppermost carburetor 25*a* and rotates the choke lever shaft 61*a.* The rotating motion of the choke lever shaft 61*a* is transmitted to the other two choke lever shafts 61*b* and 61*c* of the other two carburetors 25*b* and 25*c* through the choke interlocking levers 63*a* to 63*c* and the interlocking link 64, whereby the choke mechanisms of all the carburetors 25*a* to 25*c* are simultaneously operated and the density of the air-fuel mixture is increased, thus easily starting the operation of the engine 2.

On the other hand, the speed reduction control device 56, which utilizes a pneumatic (hydraulic) damper, is also a known one, and as shown in FIG. 4, a damper rod 66 extending from the speed reduction control device 56 abuts against a tappet 68 provided for the front end portion of a damper lever 67 which is mounted to the left end portion, as viewed, of the throttle shaft 40*a* of the uppermost carburetor 25*a* to be integrally rotatable. The respective carburetors 25*a* to 25*c* have minimum degree of throttle opening in a state that the throttle levers 41*a* to 41*c* are rotated to the uppermost positions thereof, as shown in FIG. 3, and at that time, the damper lever 67 is also rotated to the uppermost position so as to push the damper rod 66 of the speed reduction control device 56 in the contracting direction.

As the degree of the throttle opening is increased by rotating downward the throttle levers 41*a* to 41*c* of the respective carburetors 25*a* to 25*c,* the damper lever 67 is also rotated downward and the damper rod 66 of the speed reduction control device 56 extends. In this operation, if the throttle closing operation is rapidly performed, the damper lever 67 is liable to be rapidly rotated upward by the urging force of the springs 50 of the carburetors 25*a* to 25*c.* However, according to the attenuation function caused by the speed reduction control device 56, a resistance is caused against the contraction of the damper rod 66, so that the closing speed for closing the throttle valve is delayed (made slow) and the engine stall can be hence prevented.

Incidentally, in the described starting operation assisting device 52, the length (extension/contraction) of the operation rod 57 is adjusted by an adjustment nut 57*a* arranged to a base portion (on the side of the assisting device body) of the operation rod 57 so as to carry out a setting working for properly setting the initial position of the choke cam 60 with respect to the choke lever 62. Further, in the speed reduction control device 56, the tappet 68 disposed to the front end portion of the damper lever 67 is adjusted to thereby carry out a setting working for properly setting the initial positions of the damper rod 66 and the damper lever 67.

In the fuel supply apparatus 15 of the outboard motor of the present invention of the structure mentioned above, the starting operation assisting device 52 and the speed reduction control device 56 are both mounted to the interlocking mounting member 26 and unitized as one assembly together with the three carburetors 25*a* to 25*c* as air-fuel mixture supply means. Therefore, the setting workings mentioned above can be carried out before the assembling of the fuel supply apparatus 15 to the engine 2, and thus, it is not necessary to perform such setting workings on the assembling line of the engine 2, resulting in the easy manufacturing of the outboard motor 1 with substantially no scattering of the engine performance which may be caused through the setting workings.

Furthermore, even if the fuel supply apparatus 15 is disassembled entirely from the engine 2, the relative positional relationship of the starting operation assisting device 52 and the speed reduction control device 56 with respect to the carburetors 25*a* to 25*c* is not changed, so that it is not necessary to carry out the setting workings mentioned above every time of mounting or dismounting the fuel supply apparatus to or from the engine 2. Accordingly, the operability or operational performance of the engine 2 can be remarkably improved.

Further, the intake pipes 27 are coupled to the carburetors 25*a* to 25*c* through the fastening of stud bolts 71 and nuts 72 provided for the carburetors 25*a* to 25*c* so as to project therefrom. The intake noise silencer 28 is mounted to the intake pipes 27 through a plurality of screws 73. These intake pipes 27 and the intake noise silencer 28 may be detachably mounted to the carburetors 25*a* to 25*c* from the rear side thereof after the carburetors 25*a* to 25*c* have been mounted to the engine 2.

That is, in the described embodiment, the mutually interlocked intake pipes 27 and the intake noise silencer 28 are mounted from the front side of the carburetors 25*a* to 25*c,* and at such mounting time, the engine 2 and other members are arranged so as not to interfere with the intake pipes 27 and the intake noise silencer 28. According to such arrangement, since the intake pipe 27 and the intake noise silencer 28 can be mounted to the carburetors 25*a* to 25*c* which had already been mounted to the engine 2, it is not necessary to mount these intake pipe and silencer in the initial assembling stage. Accordingly, the interlocking mount member 26, the carburetors 25*a* to 25*c,* the starting operation assisting device 52 and the speed reduction control device 56, assembled in one small unit, can be easily mounted to the engine 2, whereby the packaging, transportation, maintenance and the like working of the fuel supply apparatus 15 can be made easy and improved.

It is to be noted that the present invention is not limited to the described embodiment and many other changes and modifications may be made without departing from the scopes of the appended claims.

What is claimed is:

1. A fuel supply apparatus of an outboard motor having an engine with a crankcase in which a crankshaft is perpendicularly arranged in a state that the outboard motor is mounted to a hull, said fuel supply apparatus comprising:

an interlocking mount member adapted to be mounted to the engine;

a plurality of air-fuel mixture supply devices mounted to said interlocking mount member;

an intake noise silencer mounted to said air-fuel mixture supply devices;

a starting operation assisting means adapted for assisting smooth starting of the engine; and a speed reduction control means adapted for preventing an engine stall from occurring, said starting operation assisting means and said speed reduction control means being mounted to said interlocking mount member.

2. A fuel supply apparatus according to claim 1, wherein said intake noise silencer is detachably mounted to said plurality of air-fuel mixture supply devices after said plurality of air-fuel mixture supply devices are mounted to the engine.

3. A fuel supply apparatus according to claim 2, wherein said intake noise silencer is mounted to said plurality of air-fuel mixture supply devices through intake pipes.

4. A fuel supply apparatus according to claim 1, wherein said plurality of air-fuel mixture supply devices are a plurality of carburetors.

* * * * *